US006794577B1

(12) United States Patent
Bhogal

(10) Patent No.: US 6,794,577 B1
(45) Date of Patent: Sep. 21, 2004

(54) CONFIGURABLE CABLE FOR USE IN A DATA PROCESSING NETWORK

(75) Inventor: Kulvir Singh Bhogal, Fort Worth, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/401,332

(22) Filed: Mar. 27, 2003

(51) Int. Cl.[7] ..... H01B 7/34

(52) U.S. Cl. ..... 174/74 R

(58) Field of Search ..... 174/36, 102 R, 174/113 R, 102 C, 106, 74 R, 74 D, 79

(56) References Cited

U.S. PATENT DOCUMENTS

| | | | | | |
|---|---|---|---|---|---|
| 4,579,407 | A | * | 4/1986 | Shimada | 439/502 |
| 4,954,101 | A | * | 9/1990 | Nelson | 439/502 |
| 5,113,159 | A | * | 5/1992 | Adriaenssens et al. | 333/12 |
| 5,945,631 | A | * | 8/1999 | Henrikson et al. | 174/34 |
| 6,297,445 | B1 | * | 10/2001 | Yamada et al. | 174/33 |
| 6,310,286 | B1 | * | 10/2001 | Troxel et al. | 174/36 |
| 6,364,535 | B1 | * | 4/2002 | Coffey | 385/53 |

OTHER PUBLICATIONS

Making a Crossover Coupler: A Cheaper Alternative to a Crossover Cable, http:www.kan.org/networking/crossover.html, pp. 1–6.

Cat5E Ethernet Crossover Adapter, Tech World, http:www.twstore.com/c5xover.html; p. 1 of 1.

* cited by examiner

*Primary Examiner*—William H. Mayo, III
(74) *Attorney, Agent, or Firm*—Joseph P. Lally; Leslie A. Van Leeuwen

(57) ABSTRACT

A network cable includes first and second connectors and corresponding sets of connector pins and signal wires. A coupling piece controls the routing between the first set of signal wires and the second set of signal wires. The coupling piece includes at least two configuration settings where each configuration setting actuates a corresponding routing between the two sets of signal wires. The first configuration setting may actuate a passthrough configuration where each first connector pin is connected to a like numbered second connector pin. The second configuration may actuate a crossover configuration in which at least some of the first connector pins are connected to like numbered second connector pins and at least some of the first connector pins are connected to un-like numbered second connector pins. The coupling piece may include a cylindrical outer piece that rotates around an inner piece to actuate the various configuration settings.

17 Claims, 4 Drawing Sheets

CONFIGURABLE CABLE FOR USE IN A DATA PROCESSING NETWORK

BACKGROUND

1. Field of the Present Invention

The present invention generally relates to the field of electronic signal cables and more particularly to cables used to connect one or more data processing systems in a data processing network.

2. History of Related Art

Wired computer networks typically include one or more data processing systems that are connected by some form of cabling. Among the most pervasive types of cable are the various types of Ethernet cables. Ethernet refers to network hardware and protocols that comply with IEEE 802.3. Ethernet cables provide the physical medium that connects systems in an Ethernet network. The most common Ethernet networks today are 10 Megabit/second and 100 Megabit/second networks. Many of these networks employ twisted pair wire cabling as the most cost effective means of connecting systems in high data-rate networks.

Referring to FIG. 1A and FIG. 1B, two of the most commonly encountered methods of connecting multiple systems in a LAN are depicted. In FIG. 1A, a "direct connect" network 100 includes a first data processing system 102, a second data processing system 104, and a cable 106 connected between them. Data processing systems 102 and 104 may be implemented with any of a variety of microprocessor based computing systems including laptop and desktop personal computers, server systems, and so forth.

Cable 106 is typically a CAT 5 twisted pair cable that includes 8 wires (4 pairs). In an Ethernet embodiment, these 8 wires include plus and minus transmit wires (T+, T−), plus and minus receive wires (R+, R−), and four power signals (GND, VDD, etc.). In a direct connect network 100, it is necessary to connect the receive wires of one device to the transmit wires of the other device and vice versa Thus, in FIG. 1A, the R+ connection of system 102 is connected to the T+ connection of system 104, the R− connection of system 102 is connected to the T− connection of system 104 and so forth. This connection configuration is commonly referred to as a "crossover" connection and the cable 106 that implements the crossover connection is referred to as a crossover cable.

In the network 110 as depicted in FIG. 1B, multiple data processing systems, two of which are represented by systems 112 and 114, are connected to ports 122 and 124 of a hub 120 via cables 16 and 118 respectively. The hub configuration of network 110 beneficially enables multiple systems to connect to a common hardware device to create a LAN that includes several systems. In an Ethernet implementation of network 110, hub 120 is typically configured to connect to systems 112 and 114 using a "pass through" configuration in which the T+/− and R+/− signals of the individual systems connect to the corresponding signal in the connection ports 122 and 124. Thus, for example, the T+ signal of system 112 is connected to the T+ signal of port 122 on hub 120.

It will be appreciated that it may be desirable to alter network configurations from time to time for any of a variety of reasons. Thus, for example, a particular system or pair of systems may at one time be part of a direct connect network such as network 100 while, at other times, they may comprise a portion of a hub configuration 110. It would be desirable to implement a cable that could accommodate either configuration without significantly increasing the cost or complexity of the cable and without an appreciable loss of reliability.

SUMMARY OF THE INVENTION

The problems identified above are in large part addressed by a network cable according to the present invention. The cable includes a set of signal wires connected between a pair of connectors and has at least two configuration settings. In a first configuration setting, the pass-through configuration setting, the cable's signal wires are connected between like connector pins such that, for example, pin 1 of a first connector is connected to pin 1 of a second connector, pin 2 of the first connector is connected to pin 2 of the second connector and so forth. In a second configuration, the crossover configuration, at least a subset of the signal wires connect unlike connector pins such that for example, pin 1 of the first connector may be connected to pin 3 of the second connector.

The cable is preferably transitionable from the first cable setting to the second cable setting by hand. In one embodiment, the cable includes a substantially cylindrical coupling piece intermediate between the two connectors. The coupling piece receives signal wires from the two connectors and provides a mechanism for coupling the signal wires from the first connector to the signal wires from the second connector. In one embodiment, the cylindrical coupling piece includes an annular outer shell that encloses an inner cylindrical piece. The outer shell may be rotated around the inner piece from a first position to a second position. When in the first position, the cylindrical coupling piece connects the signal wires of the two connectors in a first configuration while, in the second configuration, the coupling piece connects the signal wires in a second configuration.

In other embodiments, the cable may include alternative forms of coupling pieces. In one embodiment, the coupling piece includes a hand settable switch. The position of the switch dictates the coupling configuration such that a first position of the switch enables a first coupling configuration, a second position of the switch enables a second coupling configuration, and so forth. Another embodiment of the coupling piece includes a mechanism that is configured to retract the cable ends when not in use.

BRIEF DESCRIPTION OF THE DRAWINGS

Other objects and advantages of the invention will become apparent upon reading the following detailed description and upon reference to the accompanying drawings in which.

Figure 1A:
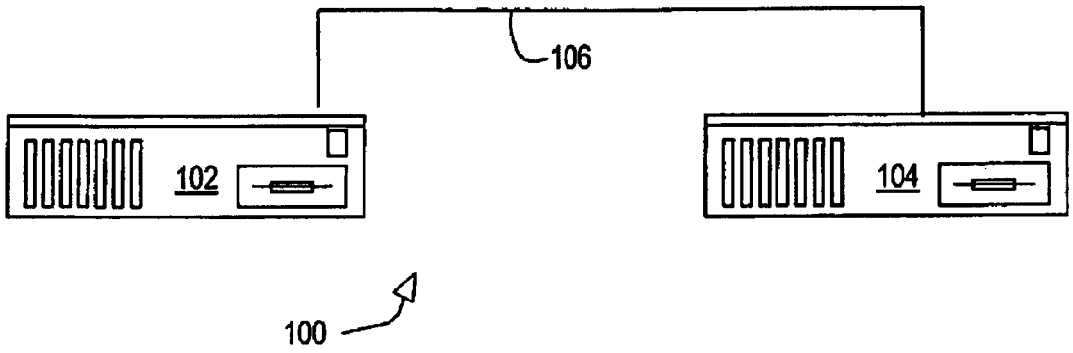
FIG 1A (PRIOR ART)
FIG. 1A depicts a direct connection computer network according to the prior art.
Figure 1B:
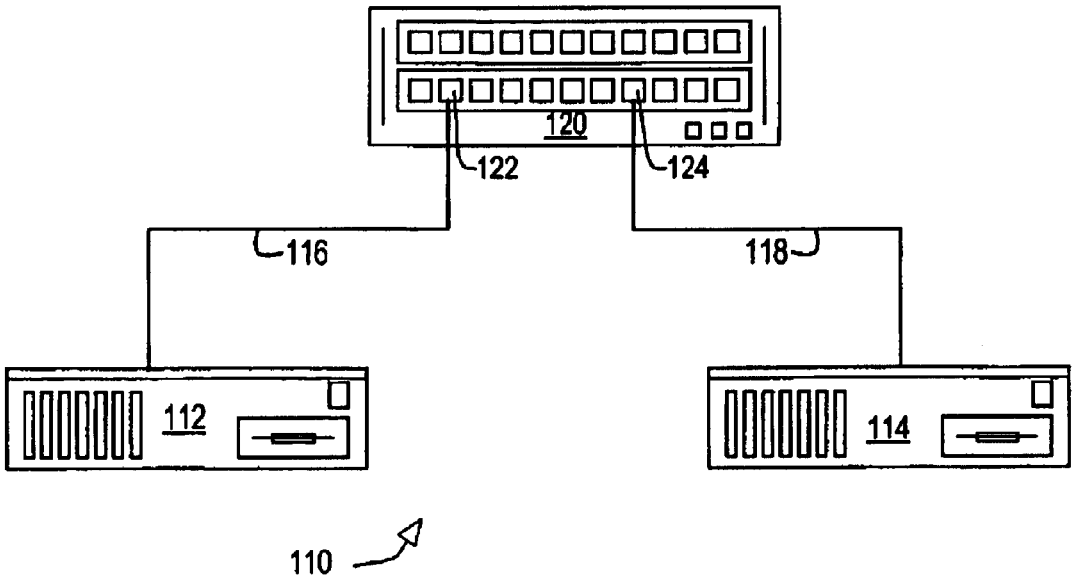
FIG 1B (PRIOR ART)
FIG. 1B depicts a computer network employing a hub according to the prior art.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF THE INVENTION

The present invention generally encompasses cables used in computer networks and more specifically cables that incorporate multiple configuration settings. These configurable cables include some form of mechanism by which a user can alter the cable's configuration from a first configuration to a second configuration. As used in the context of this disclosure, a cable configuration refers to the specific manner in which the cable connects two (or more) devices. In an embodiment suitable for use in the widely installed base of Ethernet systems, for example, the configurable cable according to the present invention includes a pass-through configuration in which the cable connects like connector pins (pin 1 to pin 1, pin 2 to pin 2, etc.) and a crossover configuration in which the cable connects at least some pins of its first connector to unlike pins of its second connector (e.g., pin 1 to pin 3). In one specific implementation according to this embodiment, the pass-through configuration is suitable for connecting a data processing system to a hub or other similar network connection device while the crossover configuration is suitable for directly connecting two data processing systems to each other in an Ethernet configuration.

Figure 2A:
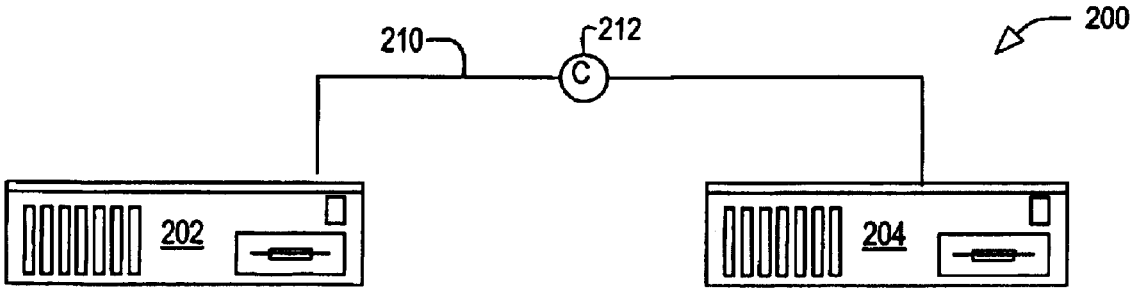
FIG. 2A depicts selected elements of a computer network including a configurable cable according to the present invention.
Figure 3A:
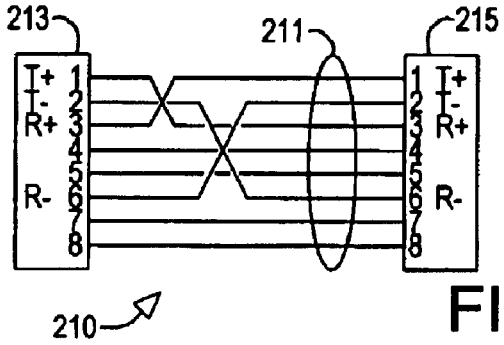
FIG. 3A illustrates one embodiment of the configurable cable's wiring for use in the network of FIG. 2A.

Turning now to the drawings, FIGS. 2A and 3A illustrate a first embodiment of a data processing network 200 incorporating a configurable cable 210 according to the present invention. In the depicted embodiment, network 200 includes a first data processing system 202 that is directly connected (connected without an intervening system or box) to a second data processing system 204 by configurable cable 210. Configurable cable 210 includes a coupling piece 212 that is alterable between at least a first configuration and a second configuration.

As depicted in greater detail in FIG. 3A, configurable cable 210 and coupling piece 212 are connected in a crossover configuration suitable for use in a direct connect Ethernet network. In this embodiment, configurable cable 210 includes eight signal wires typically arranged as 4 twisted pairs. The eight signals include plus and minus transmit signals (T+, T−) and plus and minus receive signals (R+, R−). In the direct connect configuration, also referred to as the crossover configuration denoted by the "C" in coupling piece 212, the T+/− signals of the first device are connected to the R+/− signals of the second device and vice versa.

More specifically, configurable cable 210 includes a set of signal wires 211 each connected at a first end to a first connector 213 and each connected at a second end to second connector 215. In one embodiment, first and second connectors 213 and 215 are implemented with standard, 8-pin RJ45 connectors that will be familiar to those knowledgeable in the field of wired LANS. In the crossover configuration, cable 210 connects a first subset of its signal wires to like pins of the two connectors and a second subset of its signal wires to unlike pins. Specifically, the first set of signals wires includes the signal wires connected to pins 4, 5, 7, and 8 while the second set of signal wires includes the signal wires connected to pins 1, 2, 3, and 6. In the first set of signal wires, each signal wire is connected to the same pin number at each connector while in the second set of signal wires, each signal wire is connected to a pin number of connector one that differs from the connector two pin number to which the wire is connected.

The crossover configuration of FIG. 3A beneficially enables two data processing systems to communicate with each other over physical medium connected between the two devices without any intervening connection device or box such as a router, hub, and so forth. Although the direct connect system has limitations, it represents a low cost option for sharing resources between two separate systems.

Figure 2B:
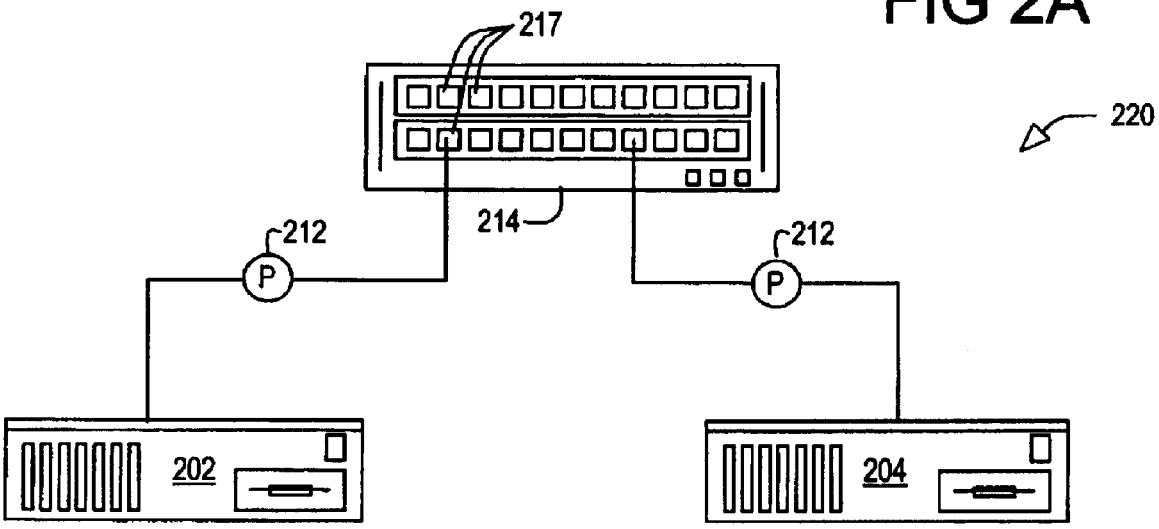
FIG. 2B depicts selected elements of an alternative embodiment of a computer network including a configurable cable according to the present invention.
Figure 3B:
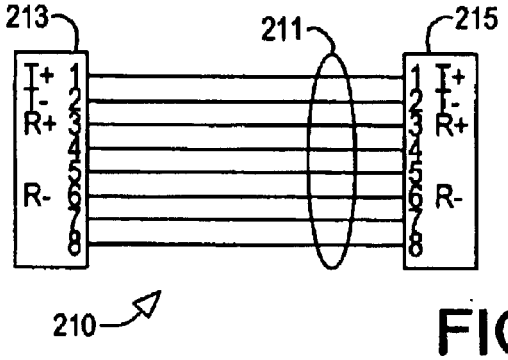
FIG. 3B illustrates one embodiment of the configurable cable's wiring for use in the network of FIG. 2B.

Referring now to FIGS. 2B and 3B, a data processing network 220 employing configurable cable 212 is illustrated. As depicted in FIG. 2B, network 220 includes a first data processing system 202, a second data processing system 204, and a hub 214. Hub 214 includes multiple ports 217 each of which may be used to connect to a data processing system. In this configuration, data processing systems 202 and 204 are each connected to hub 214 via a corresponding configurable cable 210. In this hub configuration, the coupling piece 212 of each configurable cable 210 is set to the pass through configuration setting denoted by the "P" within coupling piece 212. As suggested by its name, the pass through configuration (shown in FIG. 3B) is a configuration in which each of the signal wires 211 is connected between a like pair of connector pins. In other words, pin 1 of first connector 213 is connected to pin 1 of second connector 215, pin 2 of connector 213 is connected to pin 2 of second connector 215, and so forth. The hub configuration of FIG. 2B is useful for connecting multiple (more than two) systems in a single network via a common hardware component. In an Ethernet compliant network, hub 214 is configured to receive signals from its systems in the pass through configuration.

Configurable cable 210 according to the present invention is designed to be easily altered from a first configuration such as the crossover configuration of FIG. 3A to a second configuration such as the passthrough configuration of FIG. 3B. The alternation of the cable's configuration may be achieved manually or electrically. Preferably, the cable's configuration may be altered from the first to the second configuration and back without the use of tools and or other external equipment.

Figure 4A:
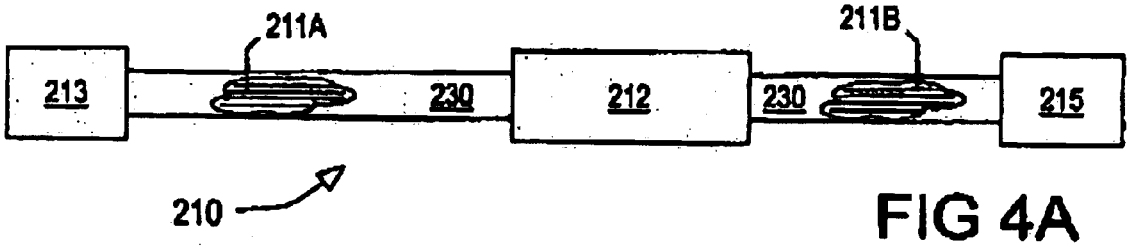
FIG. 4A depicts an alternative embodiment of a configurable cable according to the present invention.
Figure 4B:
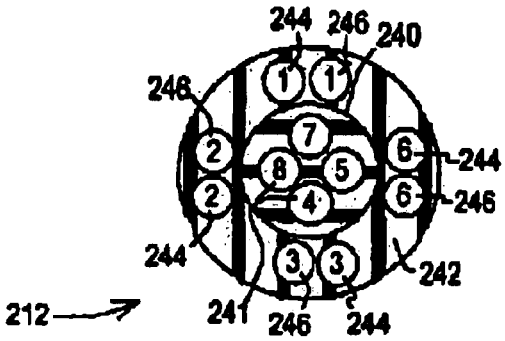
FIG. 4B is a cross-sectional view of the configurable cable of FIG. 4A.

Referring now to FIGS. 4A and 4B, a cylindrical in-line embodiment of configurable cable 210 and coupling piece 212 is depicted where FIG. 4B is a cross-sectional view of the coupling piece 212 of FIG. 4A. In this embodiment, configurable cable 210 includes a first set of signal wires 211A connected to first connector 213 and a sheathing 230 that encloses the signal wires. Cable 210 further includes a second set of signal wires 211B connected to second connector 215. Coupling piece 212 connects to the first set of signal wires 211A and the second set of signal wires 211B.

Coupling piece 212 controls the routing between first and second signals wires 211A and 211B. The depicted embodiment of coupling piece 212 is substantially cylindrical in shape as is the cable sheathing 230. The diameter of coupling piece 212 may be equal to or somewhat greater than the diameter of sheathing 230.

As shown in the cross sectional view of FIG. 4B, the depicted embodiment of coupling piece 212 includes a cylindrical inner piece 240 surrounded by an annular outer piece 242. Annular outlet piece 242 is rotatable around inner piece 240 from at least a first position to a second position. The inner piece 240 includes conductive conduits 241 positioned so as to connect to at least a subset of the signal wires 211 in sheathing 230. In one embodiment, the set of signal wires 211 that connect to conductive conduits 211 of inner piece 240 represent a set of signal wires that are passed through to like connector pins regardless of the configuration setting. In the RJ45 Ethernet embodiment, for example, the signal wires that would connect to conductive conduits 241 would include signals 4, 5, 7, and 8 (the signal wire numbers for this particular implementation are indicated in FIG. 4B in each conductive conduit 241).

The annular outer ring 242 includes at least two sets of conductive conduits. A first set of conduits 244 serve as the active conduits when annular ring 242 is in a first position relative to inner piece 240 while the second set of conduits 246 serve as the active conduits when the annular outer ring 242 is in a second position relative to inner piece 240. When the annular outer ring 242 is in the first position relative to inner piece 240 the first set of conduits 244 connect the pins of the configurable cable's first connector to the pins of the cable's second connector in a first configuration. When the outer ring 242 is in a second position relative to inner piece 240, the second set of conduits 246 connect the first connector's pins to the second connector's pins in a second configuration. In one embodiment, for example, the first set of conduits 244 connect connector pins 1, 2, 3, and 6 (indicated inside each of the conduits 244 and 246) in a passthrough configuration while the second set of conduits 246 connect pins 1, 2, 3, and 6 in a crossover configuration as shown in FIG. 3B.

Figure 6A:
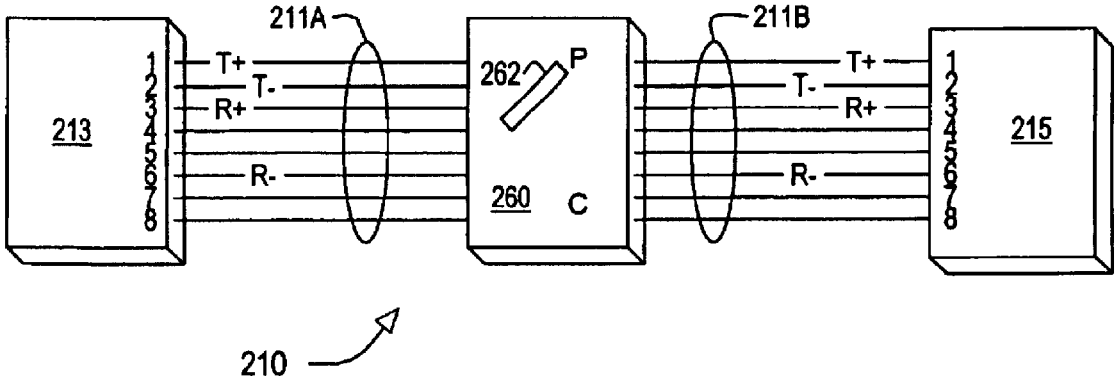
FIG. 6A is an embodiment of the configurable cable of the present invention shown in a first configuration.
Figure 6B:
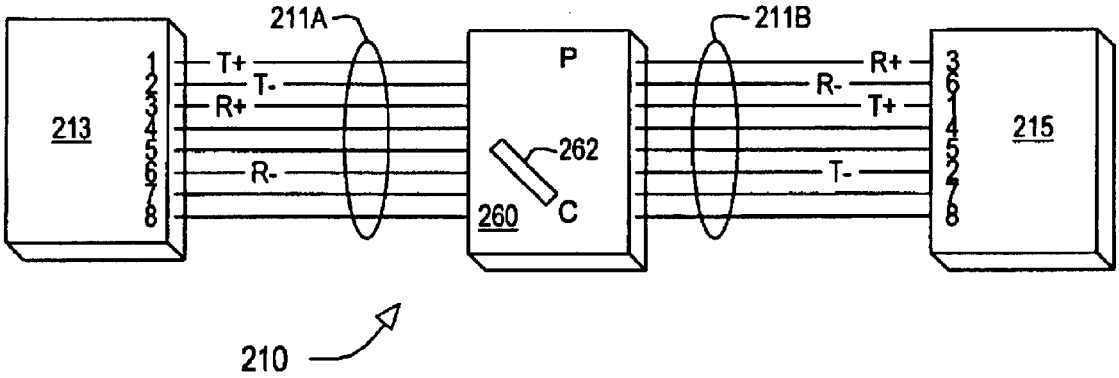
FIG. 6B is an embodiment of the configurable cable of the present invention shown in a first configuration.

Referring now to an embodiment of configurable cable 210 depicted in FIGS. 6A and 6B, a switch 260 is included within the cable between first connector 213 and second connector 215. Switch 260 receives the signals wires from first connector 213 and second connector 215. In the depicted embodiment, configurable cable 210 includes a total of eight signal wires 211A connected between first connector 213 and switch 260 and a second set of eight signal wires 211B connected between second connector 215 and switch 260. First and second sets of signal wires 211A and 211B are collectively referred to herein as signal wires 211. Switch 260 controls the routing between first set of signal wires 211A and second set of signal wires 211B.

Although not shown in FIG. 6A and FIG. 6B to maintain clarity, it will be appreciated that signal wires 211 may be arranged as a set of four twisted pairs and that configurable cable 210 may include more or fewer signal wires than eight. The depicted embodiment of cable 210 is suitable for use in a 10, 100, or 1000 Mbps Ethernet network. Switch 260 as shown includes a mechanically actuated dial 262 that may be set in one of at least two positions or settings. In the Ethernet compatible embodiment, for example, dial 262 may be set in a passthrough position (P) as shown in FIG. 6A or in a crossover position (C) as shown in FIG. 6B. In the passthrough setting, the signal wires 211 connect same numbered pins of first connector 213 and second connector 215 as is desirable in a hub-type Ethernet environment. In the crossover setting, at least some of the signal wires 211 are connected to unlike pin numbers on connectors 213 and 215. With respect to the Ethernet compatible embodiment depicted, for example, four of the signal wires 211 are connected between unlike pin numbers. As shown in FIG. 6B, first connector pin 1 connects to second connector pin 3, first connector pin 2 connects to second connector pin 6, first connector pin 3 connects to second connector pin 1, and first connector pin 6 connects to second connector pin 2. The remaining signal wires are connected in a passthrough manner between like-numbered pins of the two connectors. This embodiment, as indicated previously, is useful for implementing a direct connect Ethernet network.

Figure 5:
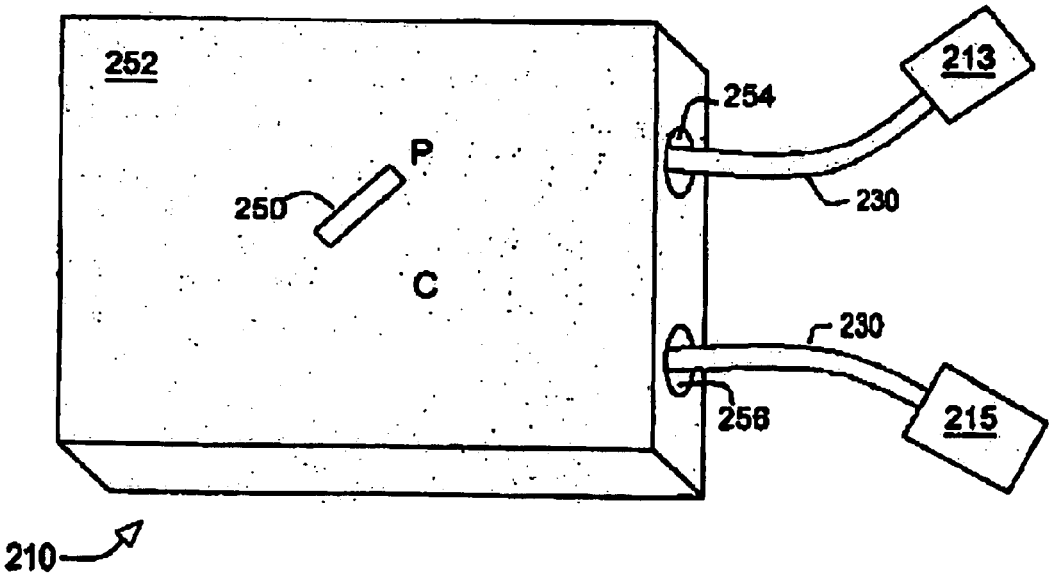
FIG. 5 is an embodiment of the configurable cable employing a cable retraction mechanism.

Referring now to FIG. 5, a retractable embodiment of configurable cable 210 is shown. In this embodiment, cable 210 includes a housing 252 having a pair of ports 254 and 256 through which corresponding ends of the cable sheathing 230 extend. Connectors 213 and 215 attach to each end of cable 210. Housing 252 includes a spring loaded or other suitable mechanism for retracting cable 210 through ports 254 and 256. In addition, housing 252 includes a switch 250 with at least two operable settings. In the depicted embodiment, switch 250 may be used in the "C" position to provide a crossover cable or a "P" position to provide a passthrough cable. A switching network within housing 250 provides the switching mechanism to achieve the two or more available configurations. The retractable embodiment integrates the benefits of a compact and mobile cable and the flexibility associated with the cable's configurability.

Although the depicted embodiments emphasize an application in which it is desirable to have two configuration settings consisting of a passthrough configuration and an Ethernet crossover configuration in which 4 of 8 signal wires are passed through while the remaining 4 wires are crossed over as described, the concept disclosed herein is applicable to cables generally. Thus, for example, the invention is intended to encompass configurable cables having more than two configuration settings, fewer or more than eight signal wires, and is not restricted to the particular configurations emphasized in the illustrations.

It will be apparent to those skilled in the art having the benefit of this disclosure that the present invention contemplates a configurable cable suitable for use in a data processing network. It is understood that the form of the invention shown and described in the detailed description and the drawings are to be taken merely as presently preferred examples. It is intended that the following claims be interpreted broadly to embrace all the variations of the preferred embodiments disclosed

What is claimed is:

1. A cable for use in a data processing network having at least two data processing devices, the cable comprising:

first and second connectors, each including a set of connector pins;

a set of signal wires connected to the pins of the first connector;

a set of signal wires connected to the pins of the second connector; and a coupling piece to control the routing between the set of signal wires from the first connector and the set of signal wires from the second connector, wherein the coupling piece includes at least two configuration settings wherein each configuration setting actuates a corresponding routing between the two sets of signal wires;

wherein the coupling piece comprises a substantially cylindrical inner piece within a cylindrical void defined by an annular outer ring, wherein the annular outer ring is rotatable, with respect to the inner piece, from a first position to a second position wherein the first and second positions correspond to the first and second settings.

2. The cable of claim 1, wherein the first configuration setting actuates a passthrough configuration in which each pin of the first connector is connected to a like numbered pin of the second connector.

3. The cable of claim 2, wherein the second configuration setting actuates a crossover configuration in which a first subset of the signal wires connected to the pins of the first connector are connected to like numbered pins of the second connector and a second subset of the signal wires connected to the pins of the first connector are connected to un-like numbered pins of the second connector.

4. The cable of claim 3, wherein the first and second sets of signal wires each includes eight wires and further wherein the crossover configuration setting is further characterized as including signal wires 4, 5, 7 and 8 in the first subset and signal wires 1, 2, 3, and 6 in the second subset.

5. The cable of claim 4, wherein the crossover configuration connects pins 1, 2, 3, and 6 of the first connector to pins 3, 6, 1, and 2 of the second connector respectively.

6. The cable of claim 1, wherein the coupling piece includes a retraction mechanism to retract at least a portion of the cable within a coupling piece housing.

7. A cable for use in a data processing network having at least two data processing devices, the cable comprising:

first and second connectors, each including a set of connector pins;

a set of signal wires connected to the pins of the first connector, wherein the first connector pins include at least one signal transmit pin and at least one signal receive pin;

a set of signal wires connected to the pins of the second connector, wherein the second connector matches the pins of the first connector; and a coupling piece to control the routing between the set of signal wires from the first connector and the set of signal wires from the second connector, wherein the coupling piece includes a pass through setting in which the transmit and receive pins of the first connector are connected to the corresponding transmit and receive pins of the second connector and a crossover setting in which the transmit pins of the first connector are connected to corresponding receive pins of the second connector and the receive pins of the first connector are connected to transmit pins of the second connector;

wherein the coupling piece comprises a substantially cylindrical inner piece within a cylindrical void defined by an annular outer ring, wherein the annular outer ring is rotatable, with respect to the inner piece, from a first position to a second position wherein the first and second positions correspond to the pass through and crossover configurations respectively.

8. The cable of claim 7, wherein the first and second sets of signal wires each include eight signal wires including transmit +/−(T+, T−) signal wires and receive +/−(R+, R−) signal wires.

9. The cable of claim 8, wherein the T+ signal wire is connected to connector pin 1, the T− signal wire is connected to connector pin 2, the R+ signal wire is connected to connector pin 3, and the R− signal wire is connected to connector pin 6.

10. The cable of claim 9, wherein in the crossover configuration, the T+, T−, R+, and R− signal wires of the first connector are connected to the R+, R−, T+, and T− signal wires respectively of the second connector.

11. The cable of claim 10, wherein each set of signal wires comprises four twisted wire pairs.

12. The cable of claim 11, wherein the first and second connectors comprise RJ45 connectors and wherein the cable is IEEE 802.3 compliant.

13. A cable suitable for use to connect a data processing system in a data processing network, the cable comprising:

a first connector having a first set of pins;

a second connector having a second set of pins; and coupling means to connect signal wires from the first set of pins to the second set of pins, the coupling means being manually operable to connect the first set of pins to the second set of pins in at least a first connection configuration and a second connection configuration;

wherein the coupling means includes a housing and a retraction mechanism to retract at least a portion of the signal wires from the first set of pins and at least a portion of the signal wires from the second set of pins.

14. The cable of claim 13, wherein the coupling means includes means for rotating a first part of the coupling piece from a first position to a second position with respect to a second part of the coupling piece, wherein the first position actuates the first connection configuration and the second position actuates the second connection configuration.

15. The cable of claim 14, wherein the first piece of the rotating means comprises an annular outer piece that defines a cylindrical void and a cylindrical inner piece positioned within the void.

16. The cable of claim 15, wherein a first subset of the signal wires from the first and second connectors are coupled via the inner piece and a second subset of the signal wires are coupled via the annular outer piece.

17. The cable of claim 16, wherein the configuration of the first subset of wires is the same in the first and second configuration settings and further wherein the configuration of the second subset of wires changes with the configuration setting.

* * * * *